United States Patent [19]
Wetter

[11] Patent Number: 4,470,529
[45] Date of Patent: Sep. 11, 1984

[54] THREAD SUCTION DEVICE

[75] Inventor: Kurt Wetter, Hagenbuch, Switzerland

[73] Assignee: Rieter Machine Works, Ltd., Winterthur, Switzerland

[21] Appl. No.: 454,990

[22] Filed: Jan. 3, 1983

[30] Foreign Application Priority Data

Jan. 15, 1982 [CH] Switzerland ..... 239/82

[51] Int. Cl.³ ..... B65H 59/22; B65H 77/00
[52] U.S. Cl. ..... 226/95; 226/97
[58] Field of Search ..... 226/97, 95; 57/304, 57/305; 83/100; 66/125 R, 131

[56] References Cited

U.S. PATENT DOCUMENTS 2,667,964 2/1954 Miller ..... 226/97
3,191,831 6/1965 Bunting ..... 226/97 X
3,424,359 1/1969 Houle et al. ..... 226/97
3,813,020 5/1974 Miller ..... 226/97
3,813,900 6/1974 Cook et al. ..... 226/97 X
4,114,790 9/1978 Sighieri ..... 226/97 X
4,366,845 1/1983 Simson ..... 226/97 X

*Primary Examiner*—Stuart S. Levy
*Assistant Examiner*—Leo J. Peters
*Attorney, Agent, or Firm*—Francis C. Hand

[57] ABSTRACT

The thread suction device has means for bunching a plurality of threads together adjacent to a nozzle opening so that the threads can be simultaneously and uniformly drawn into the suction nozzle.

In one embodiment, the nozzle is moved in order to bunch up the thread prior to drawing in of the threads. In another embodiment, a guide on the nozzle is moved in order to bunch the threads up against the nozzle prior to drawing in of the threads.

6 Claims, 4 Drawing Figures

THREAD SUCTION DEVICE

This invention relates to a thread suction device. More particularly, this invention relates to a thread suction device for use in a draw-winding or spin-draw-winding process.

As is known, various types of thread suction devices come into use in processes for treating endless filaments, for example, in draw-winding or spin-draw-winding processes. In many of the earlier processes, the suction devices were used to treat only one thread at a given spinning position. In the more recent past, the treatment of several threads in a spinning position has been known and, at least, in the future should continue to be used.

As is known, thread suction devices for removing threads usually operate in cooperation with thread monitoring elements. In this way, upon the occurrence of a disturbance at a subsequent processing location on a thread path, the thread feed to that location can be interrupted as quickly as possible. However, in the case of a multi-thread arrangement, the use of a separate suction removal device for each thread becomes expensive.

Accordingly, it is an object of the invention to provide a thread suction device which can be economically employed for a multi-thread arrangement.

It is another object of the invention to provide a relatively simple thread suction device for use in a multi-thread arrangement.

Briefly, the invention provides a thread suction device which is comprised of a thread suction nozzle for disposition in perpendicular relation to a thread path having a plurality of threads passing therethrough and means for displacing at least two of the threads into a common position adjacent to an opening of the nozzle facing the thread path.

The operation of the thread suction device is such that all of the threads in the thread path can be removed by an intensive suction simultaneously and uniformly. Further, the thread suction device can be used in a particularly economic manner since the device occupies a relatively small space and may operate, for example pneumatically.

The thread suction device can also be used with advantage for individual threads in the event that vibrations in a thread cannot be avoided at the suction removal or take-up position.

These and other objects and advantages will become more apparent from the following detailed description taken in conjunction with the accompanying drawings wherein.

Figure 1:
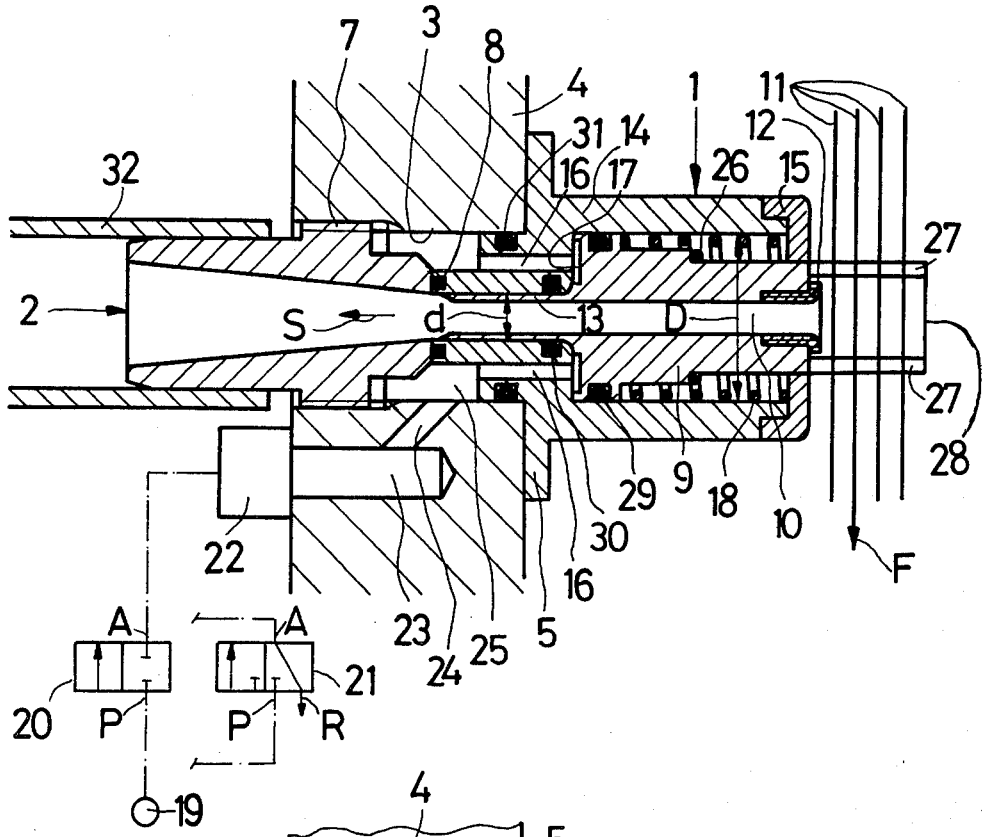
FIG. 1 illustrates a cross-sectional view of a thread suction device constructed in accordance with the invention.
Figure 2:
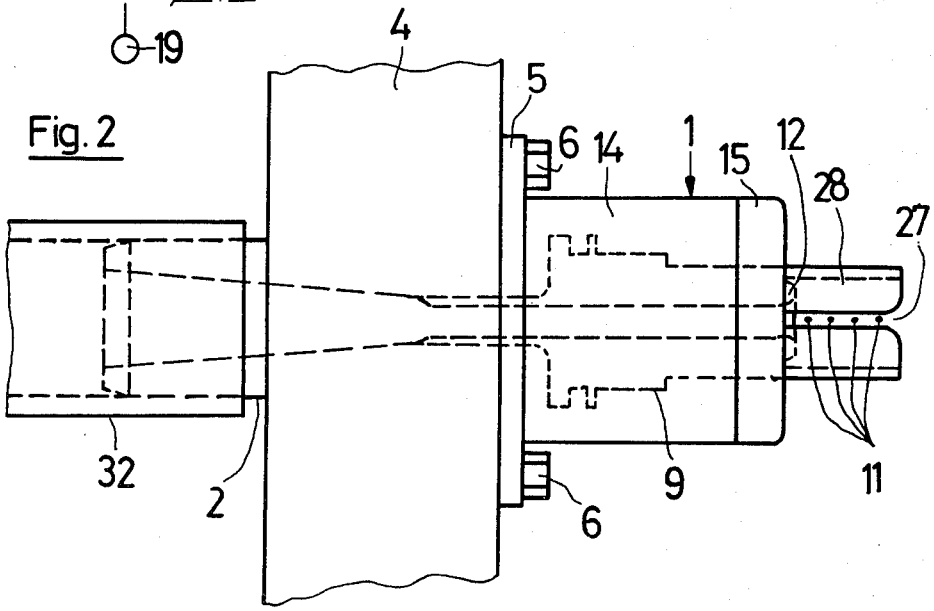
FIG. 2 illustrates a plan view of the thread suction device of FIG. 1.

Referring to FIGS. 1 and 2, the thread suction device includes a head portion 1 and a diffusor portion 2.

The head portion 1 is mounted in a bore 3 of a machine frame 4 via a flange 5. As indicated, a pair of screws 6 pass through the flange 5 to secure the head portion 1 to the machine frame 4.

The diffusor portion 2 is threaded into the machine frame 4 by means of a thread 7. In addition, the diffusor portion 2 abuts the head portion 1 at a location within the frame 4 while an O-ring 8 is positioned in the end of the head portion 1 to seal against the diffusor portion 2 to prevent the leakage of air.

As indicated, the head portion 1 includes a stationary cylinder portion 14 which is integral with the flange 5 and a cylindrical cover 15 which is fixedly secured to the cylinder portion 14. In addition, a thread suction nozzle in the form of a one way pressurable pneumatic piston 9 is slidably mounted within the head portion 1 and is secured against rotation in any suitable manner. The piston 9 has a flow channel 10 with an opening directed towards a thread path in which a plurality of threads 11 travel. In addition, an orifice portion 12 of ceramic material is fixed in the opening of the flow channel 10 to define an opening for the nozzle facing the thread path. As indicated, the nozzle 9 also has a hollow cylindrical extension 13 which continues the flow channel 10 coaxially to the passageway through the diffusor portion 2.

A means is also provided for displacing the threads 11 in the thread path into a common take-up position adjacent to the orifice portion 12 forming the nozzle opening. This means is connected with the nozzle 9 so as to move the nozzle 9 between a rest position as shown in FIG. 1 and a thread take-up position (not shown). Movement of the nozzle 9 to the thread take-up position causes the nozzle 9 to bunch the threads 11 in the thread path into the common take-up position.

As indicated, the means for displacing the nozzle 9 includes a pressure air source 19, a two/two-way valve 20 for controlling the feeding of pressurized air from the source 19 and a connecting portion 22 which communicates with channels 23, 24 in the machine frame 4. The channels 23, 24, in turn, communicate with a distributor space 25 defined by the machine frame 4, head portion 1 and diffusor portion 2 in order to deliver the pressurized air thereto. This distributor space 25, in turn, communicates via a plurality of channels 16 in the head portion 1 with a space between the head portion 1 and the nozzle 9 in order to move the nozzle 9 relative to the head portion 1 into a take-up position (not shown).

During movement, the piston 9 is guided in the cylinder portion 14 and cylinder cover 15. The pressure air acts primarily on an annular surface 17 on the piston 9 whereby, after lifting off of the piston 9, the annular surface resulting from the difference of the diameter D (i.e. the inside diameter of the cylinder 14) and the diameter d (i.e. the outside diameter of the extension 13) is pressurized.

The means for displacing the piston also includes a helical spring 18 which is loaded under pressure and which serves for returning the piston into the initial rest position illustrated in FIG. 1.

The thread suction device also includes a means for drawing the thread 11 in the take-up position into the nozzle 9 through the orifice portion 12. This means may include a separate source (not shown) of vacuum pressure downstream of the diffusor portion 2 which is sufficient to create a suction force for the air stream S. Alternatively, this means may be provided by bores in the diffusor portion 2 which are connected with the distributor space 125 in such a manner that upon flow of the pressure air through the channel (not shown) in the diffusor portion 2 an under pressure is produced in the channel 10. In such a case, the valve 20 is used since the venting required for the return movement of the piston 9 can occur through the non-illustrated channels.

In the case use is made of a separate vacuum source, the non-illustrated channels are not present. However, a three/two-way valve 21 is used to permit venting for the return movement of the piston 9.

Of note, other commercially available venturi nozzles can be used for the diffusor portion 2 and the channel 10 can be adapted to these nozzles.

Referring to FIGS. 1 and 2, the thread suction nozzle also includes a thread guide in the form of a hollow cylindrical extension 28 on the piston 9 which is provided with slits 27 to define the thread path for the threads 11. This extension 28 also serves for the diversion of the air stream before entry of the air into the orifice portion 12.

The thread suction device is also provided with seals 29, 30, 31 in order to prevent the escape of leakage air. Further, the diffusor portion 2 is connected with a hose 32 which leads directly or via a suction source to a receiving container (not shown).

In operation, in order to remove the threads 11, the valve 20 is brought into an appropriate condition for a through-flow of air from the input P to the output A of the valve. Thus, air is introduced into the thread suction device so that the nozzle 9 is moved one stroke against the cover 15. In this regard, the piston 9 is provided with an O-ring 26 for abutting against the cover 15. During this time, the orifice portion 12 pushes the threads 11 together into a single bunched or bundled thread in a common take-up position (not shown). In addition, an air stream S is produced, i.e. by separate suction means or by suitable channels in the piston 9. After a cutter device (not shown) provided downstream in the thread movement direction F has cut the threads 11, the threads 11 are then sucked away simultaneously and practically with the same suction intensity.

In the event that a separate suction source is used to create the air stream S, this source is set in operation simultaneously with the movement of the valve 21 for the through flow of pressure air from the input P to the output A.

Figure 3:
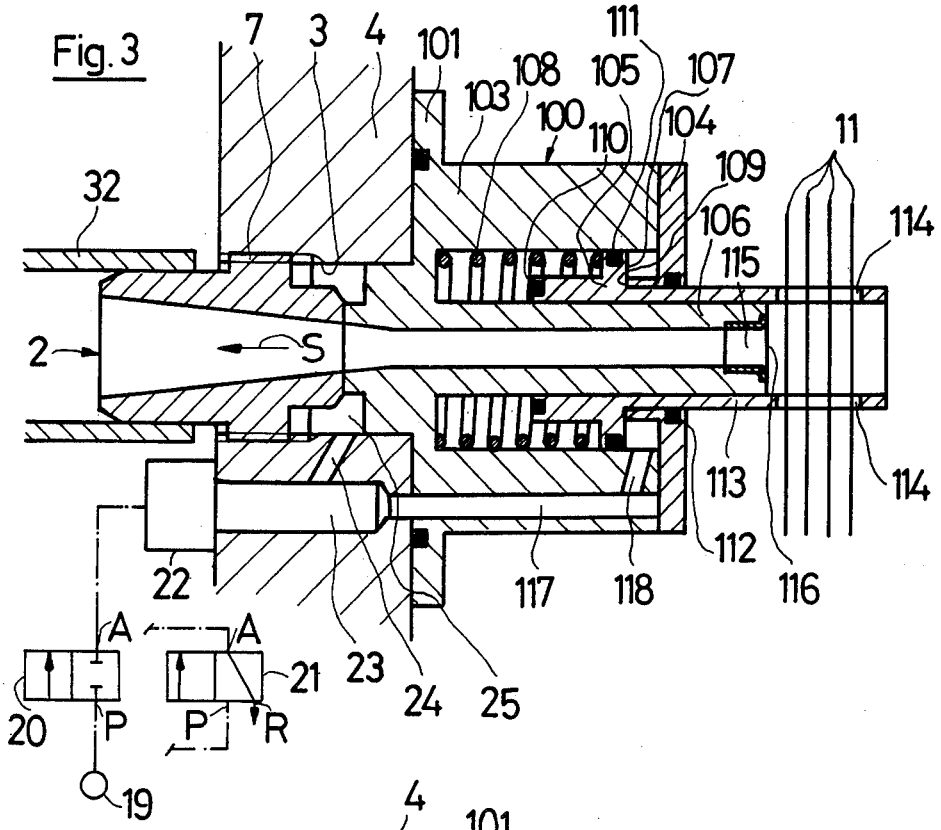
FIG. 3 illustrates a modified thread suction device according to the invention.
Figure 4:
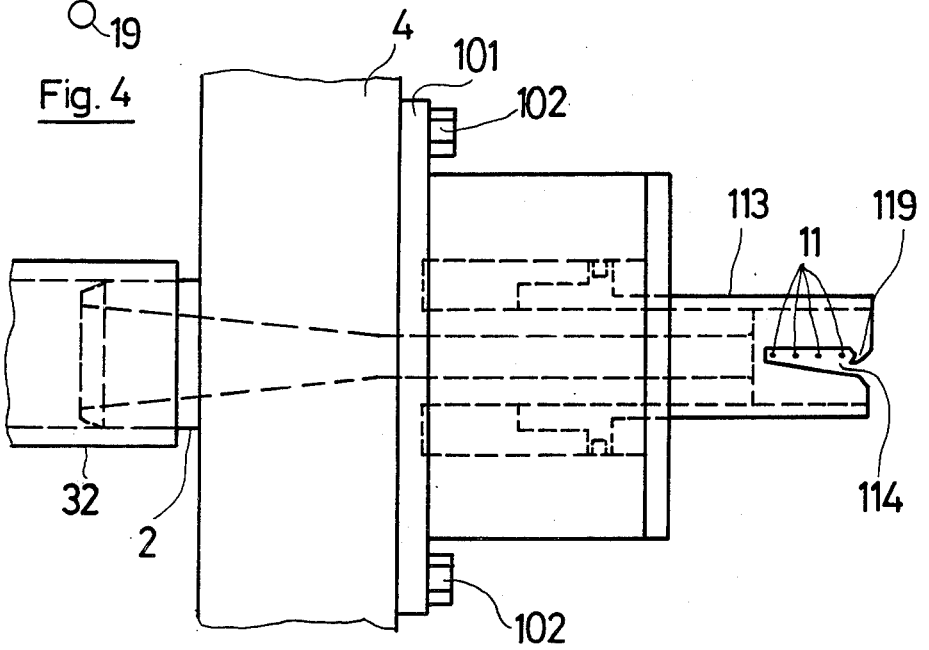
FIG. 4 illustrates a plan view of the thread suction device of FIG. 3.

Referring to FIGS. 3 and 4, wherein like reference characters indicate like parts as above, the thread suction device may alternatively be constructed with a fixed nozzle and with a movable guide. To this end, the device has a head portion 100 which is mounted in a bore 3 of the machine frame 4 and which is secured to the machine frame 4 by a pair of screws 102 which pass through a flange 101 of the head portion 100. In addition, the head portion 100 has a stationary cylinder portion 103 with a cylindrical cover 104 secured thereto. The cylinder portion 103 includes a coaxial stem 106 on which a pneumatic piston 105 is slidably mounted. This piston 105 is secured against rotation and is biased by a spring 108 into a rest position.

The piston 105 has an extension 113 which projects outwardly to form a guide. The extension 113 is of hollow cylindrical shape and has cut-outs 114 to define a thread path for the threads 11. In addition, as indicated in FIG. 4, the extension 113 has a catch 119 at one end for engaging and bunching up the threads 11 during movement of the piston 105 to a take-up position (not shown).

The means for displacing the piston 105 is pneumatically operated. As above, this means includes a source of pressurized air 19, a valve 20 (or 21) and a connecting piece 22. As indicated, the connecting piece 22 communicates with channels 23, 24 in the machine frame 4 to direct pressurized air into a distribution space 25. In addition, the channel 23 communicates via channels 117, 118 in the head portion 100 with a space between the piston 105 and the head portion 100. This space is defined in part by an annular surface 107 on the piston 105.

The stroke of the piston 105 is limited by an abutment 109 on the cover 104 and an abutment 110 on the piston 105.

In order to avoid the escape of pressure air which is required for the movement of the piston 105 into the space in which the spring 108 is located and to the atmosphere, appropriate O-ring seals 111, 112 are provided about the pressure receiving space.

In operation, the valve 20 is switched on so that air can be supplied to the space defined, in part, by the annular surface 107 of the piston 105. The piston 105 is then moved against the force of the spring 108 until the abutment 110 abuts against the head portion 100. Because of this movement, the extension 113 is also forced to move. Hence, the catch 119 engages and bunches the threads 11 together until all of the threads abut the opening piece 116. The subsequently cut threads can then be drawn away together and with practically the same intensity.

After the return of the valve 20 into the position shown in FIG. 3, the channels 23, 117, 118 are again vented so that the piston 105 is returned to the initial rest position indicated in FIG. 3 via the spring 108.

Operation of the thread suction device with the valve 21 occurs in a similar manner as described above.

Of note, the air in the space in which the spring 18 of FIG. 1 or the spring 108 of FIG. 3 is located may escape into the atmosphere during the piston stroke through an opening (not shown) in the head portion 1, 100, respectively.

The invention thus provides a thread suction device of relatively simple construction which can be used for removing a plurality of cut threads simultaneously under a substantially uniform suction force.

The invention further provides a thread suction device which can be automatically actuated in order to gather in a plurality of cut threads, for example in a spinning position of a thread processing machine.

What is claimed is:

1. A thread suction device comprising a thread suction nozzle for disposition perpendicular to a thread path having a plurality of threads passing therethrough, said nozzle having an opening facing said thread path; and means for displacing at least two of the threads into a common position adjacent each said nozzle, said means being connected with said nozzle to move said nozzle between a rest position and a take-up position whereby movement of said nozzle to said take-up position causes said nozzle to bunch the threads in said thread path into said common position.

2. A thread suction device as set forth in claim 1 wherein said means is movable relative to said nozzle and includes a catch for bunching the threads into said common position.

3. A thread suction device as set forth in claim 3 wherein said means is pneumatically operated.

4. A thread suction device as set forth in claim 1 wherein said means includes a pneumatic piston.

5. A thread suction device comprising a thread suction nozzle including an opening and a thread guide extending from said opening to define a thread path for a plurality of endless threads;

means for displacing at least two of the threads in said thread path into a common take-up position adjacent said nozzle opening, said means being connected with said nozzle to move said nozzle between a rest position and a thread take-up position whereby movement of said nozzle to said take-up position causes said nozzle to bunch the threads in said thread path into said common position; and means for drawing the threads in said take-up position into said nozzle through said opening.

6. A thread suction device as set forth in claim 6 which further comprises a head portion having said nozzle slidably mounted therein and said means for displacing said nozzle includes a valve for feeding air under pressure to a chamber between said head portion and said nozzle to move said nozzle to said take-up position.

* * * * *

UNITED STATES PATENT AND TRADEMARK OFFICE

CERTIFICATE OF CORRECTION

PATENT NO. : 4,470,529

DATED : September 11, 1984

INVENTOR(S) : Kurt Wetter

It is certified that error appears in the above-identified patent and that said Letters Patent is hereby corrected as shown below:

| Column | Line | Change from | To |
|---|---|---|---|
| 2 | 65 | 125 | - 25 - |
| 4 | 64 | 3 | - 2 - |
| 6 | 5 | 6 | - 5 - |

Signed and Sealed this

*Twenty-sixth* Day of *February 1985*

[SEAL]

*Attest:*

DONALD J. QUIGG

*Attesting Officer* *Acting Commissioner of Patents and Trademarks*